United States Patent [19]

Zellweger et al.

[11] 4,194,433

[45] Mar. 25, 1980

[54] BREECHBLOCK FOR AN AUTOMATIC FIRING WEAPON

[75] Inventors: Jürg Zellweger, Neerach; Ernst Hürlemann, Zürich, both of Switzerland

[73] Assignee: Werkzeugmaschinenfabrik Oerlikon-Buhrle AG, Zürich, Switzerland

[21] Appl. No.: 888,669

[22] Filed: Mar. 21, 1978

[30] Foreign Application Priority Data

Mar. 31, 1977 [CH] Switzerland ..... 4018/77

[51] Int. Cl.[2] ..... F41D 3/00

[52] U.S. Cl. ..... 89/190; 42/75 A

[58] Field of Search ..... 89/167, 168, 173, 176, 89/190

[56] References Cited

U.S. PATENT DOCUMENTS

| | | | |
|---|---|---|---|
| 768,665 | 8/1904 | Johnson | 89/168 |
| 3,027,672 | 4/1962 | Sullivan | 42/76 A |
| 3,198,075 | 5/1965 | Maillard | 89/190 |

*Primary Examiner*—Stephen C. Bentley
*Attorney, Agent, or Firm*—Werner W. Kleeman

[57] ABSTRACT

A breechblock for an automatic firing weapon comprising a breechblock housing having a bore in which there is connected a weapon barrel,a breechblock body is displaceably arranged in the breechblock housing. The breechblock body is equipped with at least one blocking body by means of which the breechblock body can be locked with the breechblock housing. The blocking body bears against a rest or arresting surface of a locking body inserted into the breechblock housing. The locking body is of substantially sleeve-shaped configuration and is equipped at its rear end with a cut-out or notch extending transversely with respect to the lengthwise axis of the weapon, the side walls of which form the arresting surfaces. The locking body is arranged coaxially to the weapon barrel in the aforementioned bore of the breechblock housing, and it bears with its rear end surface at a shoulder of the breechblock housing and at a rear end surface of the weapon barrel.

5 Claims, 6 Drawing Figures

BREECHBLOCK FOR AN AUTOMATIC FIRING WEAPON

BACKGROUND OF THE INVENTION

The present invention relates to a new and improved construction of a breechblock for an automatic firing weapon or gun.

The breechblock of the present invention is of the type comprising a breechblock housing have a bore in which there is secured the barrel of the weapon, a breechblock body displaceable in the breechblock housing, the breechblock body being provided with at least one blocking body by means of which the breechblock body can be locked with the breechblock housing, and the blocking body is supportable at a rest or arresting surface of a locking body inserted into the breechblock housing.

According to a prior art construction of breechblock employed at a firing weapon the breechblock housing possesses arresting or locking grooves for the blocking bodies. The markedly loaded arresting surfaces of such grooves are not arranged at the breechblock housing itself, rather at locking bodies constructed in the form of bolts and formed of wear resistant material of high strength. These bolts are mounted in bores in the breechblock housing which are directed in skewed fashion perpendicular to the lengthwise axis of the weapon. To secure such against rotation the bolts in each case are equipped with a wedge or key and the bores with a fitting groove or keyway.

By virtue of the arrangement of arresting grooves in the breechblock housing, but particularly due to the arrangement of the transversely directed bores with the grooves or keyways for the locking bodies, the breechblock housing is appreciably weakened. Upon loading the breechblock housing due to the back pressure of the cartridge sleeve during firing of the weapon, there is formed, as is known, a high concentration of stress at the region of the locking bolts, resulting in an increased danger or rupture of the breechblock housing. It is for this reason that the breechblock housing must be dimensioned to be appreciably thicker at this region, which, disadvantageously, leads to considerable increase in weight. The breechblock housing additionally has a rather complicated shape. Internally thereof there must be formed, apart from the usual openings for the weapon barrel and for the breechblock, also the aforementioned arresting or locking grooves and the bores with the grooves or keyways for the locking bodies. Since high requirements are placed upon the precision of the locking device, the fabrication and assembly of the weapon is expensive. The manufacture of the arresting grooves in the breechblock housing is additionally only then without problem, if the breechblock housing is either open at one end or constructed as a bipartite member.

SUMMARY OF THE INVENTION

Hence, with the foregoing in mind it is a primary object of the present invention to provide a new and improved construction of a breechblock for an automatic firing weapon or gun which is not associated with the aforementioned drawbacks and limitations of the prior art constructions.

Another and more specific object of the present invention aims at the provision of a new and improved construction of breechblock which simplifies the fabrication and assembly thereof and wherein the aforementioned disadvantages are effectively overcome.

Now in order to implement these and still further objects of the invention, which will become more readily apparent as the description proceeds, the invention contemplates that the locking body is constructed to be substantially sleeve-shaped and at its rear end or end face is provided with a cut-out or notch extending transversely with respect to the lengthwise axis of the weapon. The side walls of the notch or cut-out form the arresting or locking surfaces. The locking body is arranged coaxially with respect to the weapon barrel in the aforementioned bore of the breechblock housing. This locking body bears at its rear end surface at a shoulder of the breechblock housing and at a rear end surface of the weapon barrel.

What is of particular advantage with this construction of breechblock is that the locking body, for exchange or cleaning purposes, can be easily removed out of the breechblock housing and again inserted therein.

BRIEF DESCRIPTION OF THE DRAWINGS

The invention will be better understood and objects other than those set forth above, will become apprent when consideration is given to the following detailed description thereof. Such description makes reference to the annexed drawings wherein.

DETAILED DESCRIPTION OF THE PREFERRED EMBODIMENTS

Figure 1:
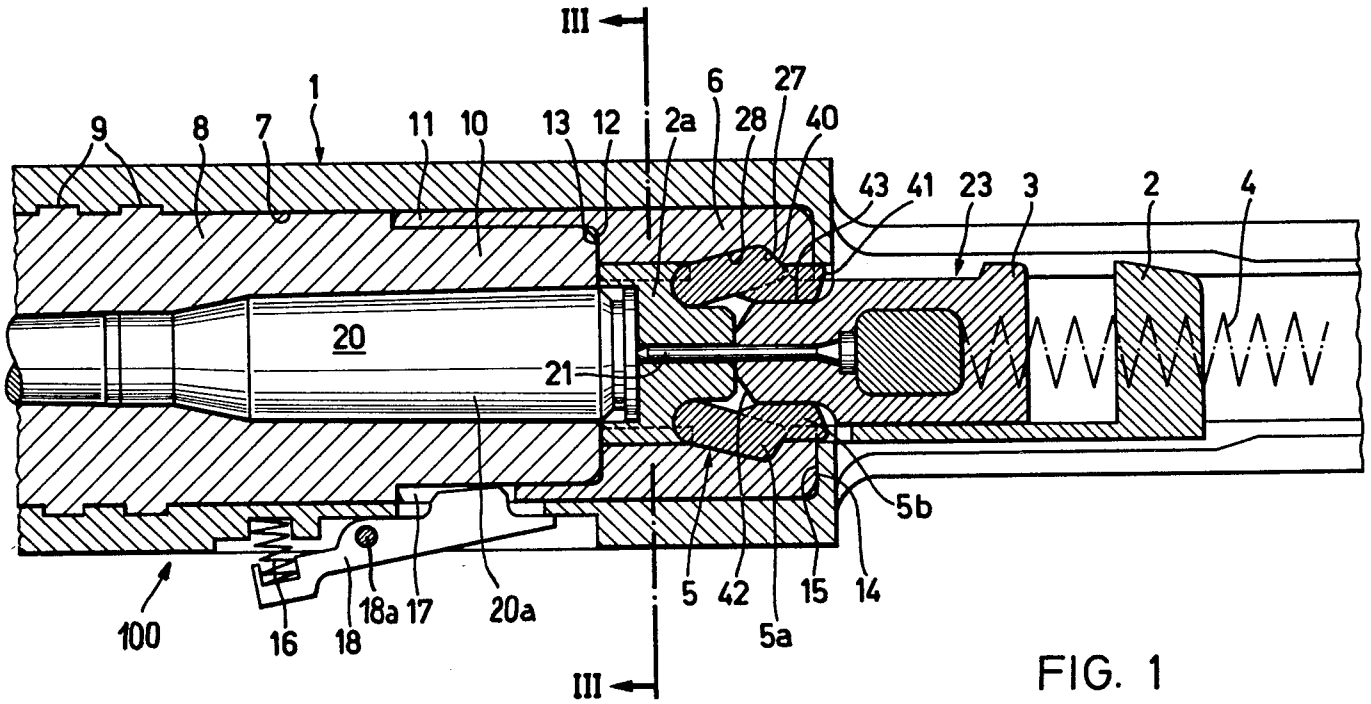
FIG. 1 is a fragmentary horizontal longitudinal sectional view through part of a firing weapon equipped with a first exemplary embodiment of breechblock constructed according to the present invention and having a breechblock body located in a firing position or locking position.
Figure 2:
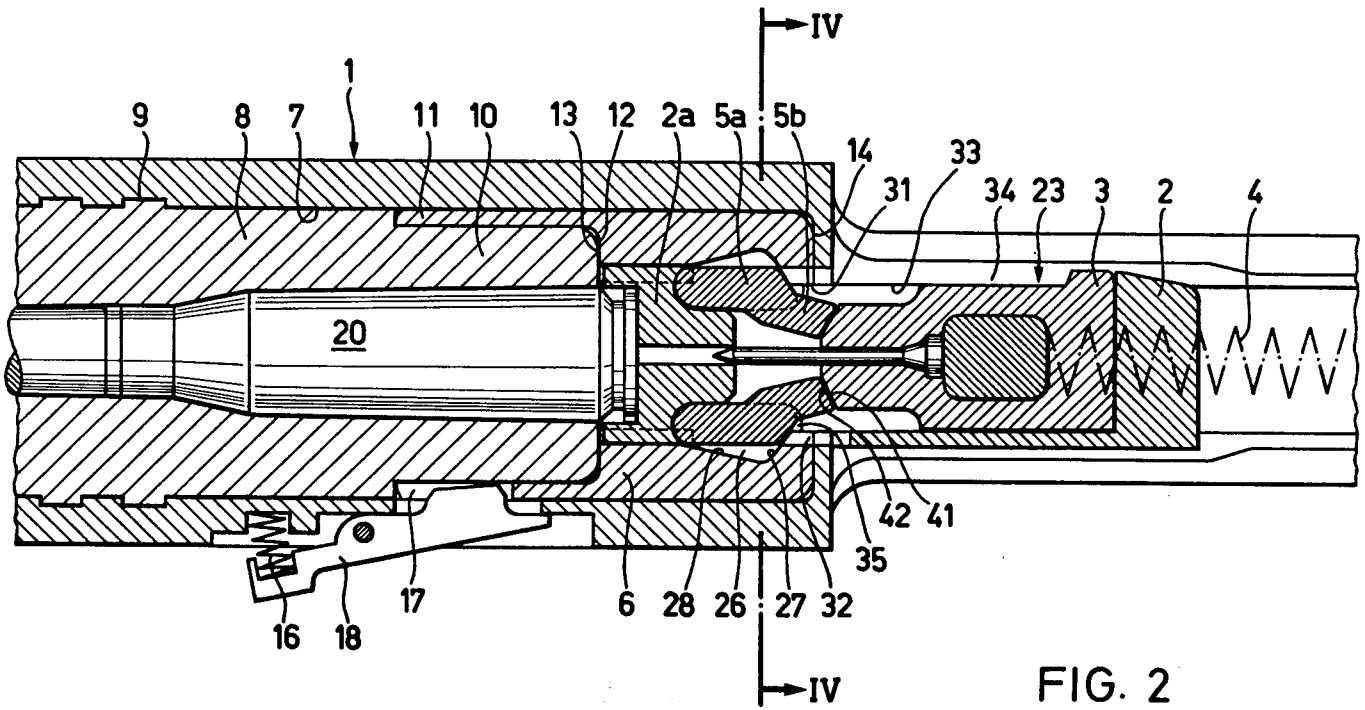
FIG. 2 is a showing of the firing weapon, like that shown in FIG. 1, but with the breechblock body located in an unlocked position.

Describing now the drawings, according to the exemplary embodiment shown in FIGS. 1 and 2 a breechblock body 23 of an automatic firing weapon or gun, generally indicated by reference character 100, is displaceably mounted in a breechblock housing 1. This breechblock body 23 comprises a breechblock head 2 and a control element or portion 3. The control element 3 is subjected to the pressure of a schematically shown closure spring 4 portrayed in phantom lines. Pivotably mounted in the breechblock head 2 are two blocking bodies 5 in conventional and therefore not further illustrated manner, and each such blocking body 5 has a front part 5*a* and a rear part 5*b*. The breechblock housing 1 possesses a substantially cylindrical bore 7 in which there are inserted the barrel 8 of the weapon 100 and a locking body 6. The weapon barrel 8 is locked in standard fashion with the breechblock housing 1 by means of a bayonet connection 9 or equivalent structure. A stepped end 10 of the weapon barrel 8 protrudes into a substantially sleeve-shaped projection 11 of the locking body 6. Its end surface or face 12 bears against a shoulder or face 13 of the locking body 6. This locking body 6 thus bears, on the one hand, in axial direction at the weapon barrel 8, and, on the other hand, by means of its rear end surface or face 14 at a shoulder 15 of the breechblock housing 1. Further, at the breechblock housing 1 there is pivotably mounted by means of the pivot pin or shaft 18*a* a lever 18 which, under the pressure of a spring 16, protrudes into a radial groove 17 provided at the sleeveshaped projection 11 of the locking body 6, whereby there is fixed and secured the radial position of the externally cylindrically constructed locking body 6 in relation to the breechblock housing 1.

In the showing of FIG. 1 a cartridge 20 is located in the weapon barrel 8. Secured to the control element 3 is a firing pin 21.

Figure 5:
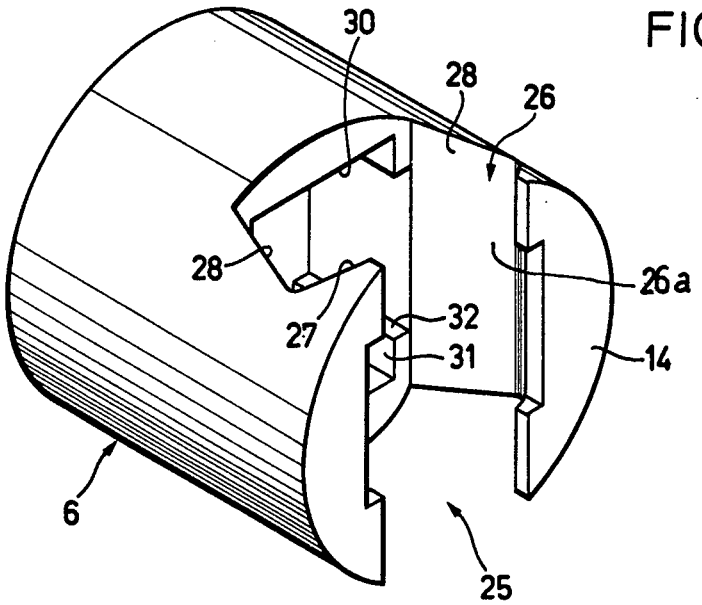
FIG. 5 is a perspective view of the locking body.

The locking body 6 which is arranged coaxially with respect to the weapon barrel 8 will be seen to be equipped at its rear end, as best shown by referring to FIG. 5, with a substantially symmetrical cut-out or notch 25 which extends continuously and transversely with respect to its lengthwise axis. The inner side walls 26*a* of this cut-out or notch 25 form arresting or locking grooves 26 for the blocking bodies 5, and the arresting surfaces 27 and 28 enclose an obtuse angle with one another, as best seen by also referring to FIGS. 1 and 2.

Figure 3:
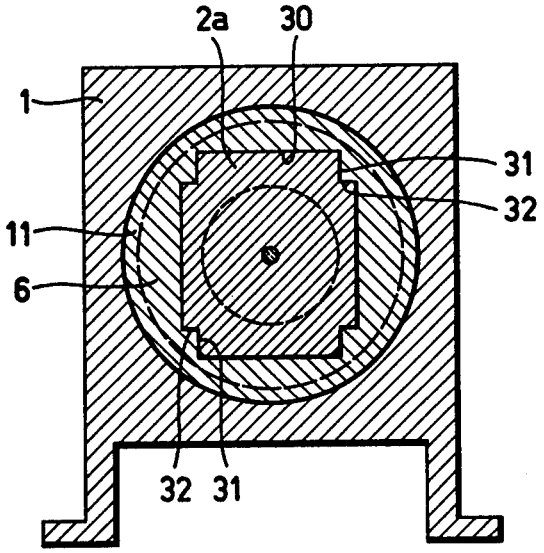
FIG. 3 is a cross-sectional view, taken substantially along the line III—III of FIG. 1.

The locking body 6 furthermore will be seen to be provided with an inner opening 30 which extends continuously in the lengthwise direction thereof and has a cross-shaped configuration in section (FIGS. 3 and 5) and which is provided with guide surfaces 31 and 32 (FIGS. 2, 3 and 5) for a front part or portion 2*a* (FIGS. 1, 2 and 3) of the breechblock head 2, and which front part 2*a* likewise possesses a substantially cross-shaped configuration in section. In axial direction the guide surfaces 31 and 32 of the locking body 6 are continued by guide surfaces 33 and 34, respectively, provided at the breechblock housing 1, as best seen by referring to FIG. 2.

Figure 4:
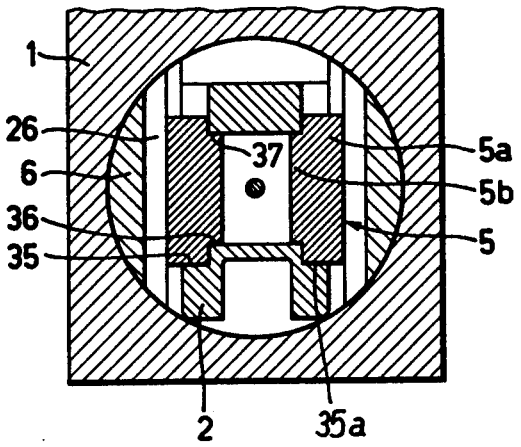
FIG. 4 is a cross-sectional view, taken substantially along the line IV—IV of FIG. 2.

As will be apparent from the showing of FIG. 4, the rears parts 5*b* of the blocking bodes 5, which are narrower than the front parts 5*a*, bear at surfaces 36 and 37 of the breechblock head 2, by means of which they are guided during pivoting or rocking of the blocking bodies 5. The front parts 5*a* bear against the base 35*a* of recesses 35 provided in the breechblock head 2, as particularly well seen from the showing of FIG. 4 and also indicated in FIG. 2.

As shown in FIG. 1 the front parts 5*a* of the blocking bodies 5 are provided with locking surfaces 40 and the rear parts 5*b* with impact surfaces 41. The control element 3 has support surfaces 42 and under-engaging surfaces 43 which coact with the blocking bodies 5.

Figure 6:
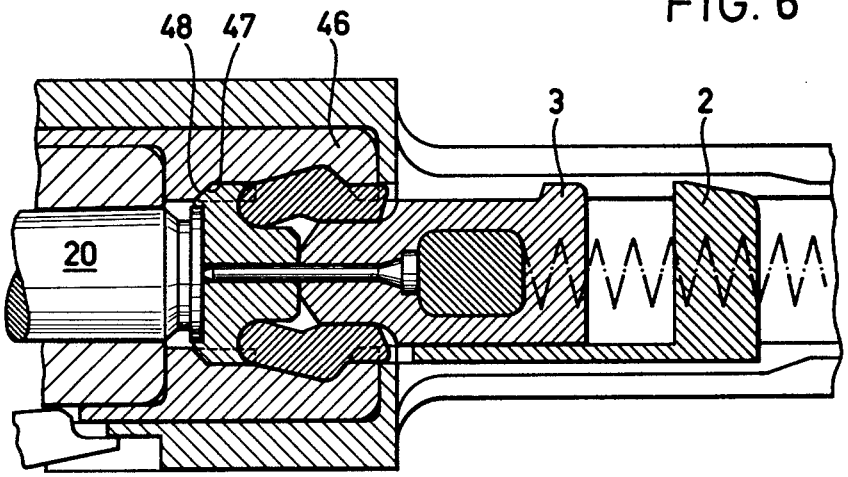
FIG. 6 is a fragmentary horizontal longitudinal sectional view through part of an automatic firing weapon equipped with a second exemplary embodiment of breechblock having a breechblock body located in the firing position.

With the second exemplary embodiment of automatic firing weapon as shown in FIG. 6, the locking body has been designated by reference character 46. In contrast to the first exemplary embodiment, here the locking body 46 is provided with contact or impact surfaces 47. In the illustrated firing position appropriate impact surfaces 48 of the breechblock head 2 bear against the contact surfaces 47.

The locking bodies 6 and 46 are fabricated of a wear resistant material of high strength.

Having now had the benefit of the foregoing discussion of the exemplary embodiments of breechblock constructions according to the present invention, the mode of operation thereof will now be considered and is as follows:

In the position of the breechblock body 23 shown in FIG. 1 the firing pin 21 fires the cartridge 20. Consequently, a projectile passes through the weapon barrel 8, and in the now empty cartridge sleeve 20*a* there prevails a propellent charge-gas pressure which is transmitted by means of the breechblock head 2 and the blocking bodies 5 to the arresting surfaces 27 of the locking body 6. The angle enclosed by the arresting surfaces 27 with the axis of the locking body 6 and thus also with the weapon axis, is selected in known fashion such that the arresting surfaces 27 do not act in a self-hemming or self-locking manner at the blocking bodies 5. It is for this reason that these blocking bodies 5 are inwardly pressed under the action of the load applied thereat and bear against the engaging surfaces 43 of the control element 3.

After the projectile has passed a conventional gas removal location (not shown) in the weapon barrel 8, then in known and therefore not further illustrated fashion the control element 3 is moved rearwardly.

At the end of this movement the blocking bodies 5 are no longer supported by the engaging surfaces 43 of the control element 3, rather they are inwardly rocked, and their locking surfaces 40 come out of engagement with the arresting surfaces 27 and the impact surfaces 41 of the rear parts 5*b* of the blocking bodies 5 come to bear at the support surfaces 42 of the control element 3 and which support surfaces are inclined with respect to the lenghtwise axis of the weapon barrel 8 (FIG. 2). The breechblock body 23 is now unlocked and is propelled rearwardly by the action of the residual gas acting upon the empty cartridge sleeve 20*a* and still located in the weapon barrel 8. Consequently, the front part 2*a* of the breechblock head 2 is initially guided by means of the guide surfaces 31 and 32 of the substantially cross-shaped opening 30, whereas the rear part already slides at the guide surfaces 33 and 34 of the breechblock housing 1.

Now when the breechblock body 23 again moves forwards, after the rear reversal, a new cartridge 21 is inserted in known manner into a not particularly illustrated cartridge magazine of the weapon barrel 8. Front part 2*a* of the breechblock head 2 again enters into the opening 30 of the locking body 6 and after impacting against the rear end surface 12 of the weapon barrel 8 comes to rest. However, the control element 3 moves further towards the front in the breechblock head 2 under the action of the closure spring 4, and thereby presses the blocking bodies 5 again towards the outside into the arresting grooves 26 against the arresting or locking surfaces 27, 28. The breechblock body 23 is again locked with the locking body 6 and thus with the breechblock housing 1.

Since the breechblock body is formed of wear resistant material of high strength, it is advanteageous according to the second discussed exemplary embodiment, to additionally arrange at the locking body 46 the contact or impact surfaces 47 for the breechblock head 2. Hence, the breechblock head 2, during forward movement, no longer impacts against the rear end surface 12 of the weapon barrel 8, rather is caught by the locking body 46.

Due to the coaxial arrangement of the locking body 6 and 46, respectively, with respect to the weapon barrel, and in which there are formed the entire arresting grooves 26 with the arresting or locking surfaces 27 and 28, it is possible to design the shape of the breechblock housing considerably more simply, more favorably as concerns its strength and with reduced weight. The breechblock housing does not possess any transversely directed recesses, constituting a source of danger of rupture of the breechblock housing, and consequently requiring thicker design and additionally causing difficulties in fabrication.

What appears to be most advantageous is the cylindrical outer shape of the respective locking bodies 6 and 46 which can be arranged in the same bore 7 as the weapon barrel 8. The force transmission then advantageously occurs by means of a closed breechblock housing. It would of course be conceivable to select a different external shape for the locking bodies, wherein in fact it would be possible to dispense with the anti-rotational securing means afforded by the lever 18 and the groove 17. Yet, this would only bring advantages in the case of a breechblock housing which is open at one end or a divided breechblock housing.

The sleeve-shaped projection 11 of the locking body 6 can be eliminated. It only serves the purpose to provide a better guiding action for the locking body 6 in the bore 7 and renders possible the arrangement of the radial groove 17 externally of the markedly loaded locking body part having the arresting grooves 26. Instead of providing the lever 18 and the groove 17 it would of course be possible to use any other known securing means which safeguard against rotation.

The inventive firing weapon is also simpler by virtue of the fact that there is employed only a single locking body which can be exchanged without any great effort.

While there are shown and described present preferred embodiments of the invention, it is to be distinctly understood that the invention is not limited thereto, but may be otherwise variously embodied and practiced within the scope of the following claims.

Accordingly, what we claim is:

1. A breechblock for an automatic firing weapon comprising:

a breechblock housing having a bore;

a weapon barrel rigidly secured in said bore;

securing means for securing said weapon barrel in said bore;

a breechblock body displaceably arranged in said breechblock housing;

two blocking bodies pivotably mounted on said breechblock body for locking the breechblock body with said breechblock housing;

a locking body possessing a substantially sleeve-shaped configuration and arranged substantially coaxially with respect to the weapon barrel in said bore of the breechblock housing;

said locking body having two arresting surfaces at each of which bears one of said blocking bodies;

said locking body having a rear end face and a further face spaced from said rear end face;

said breechblock housing having shoulder means;

said weapon barrel having a rear end surface;

said locking body being held by means of its rear end face in abutting relation with said shoulder means of said breechblock housing and by means of its further face in abutting relation with said rear end surface of the weapon barrel;

said rear end face of the locking body being provided with a cut-out extending substantially transversely with respect to the lengthwise axis of the weapon; and said cut-out having two opposed side walls, each side wall forming one of said arresting surfaces.

2. The breechblock as defined in claim 1, wherein:

said locking body has essentially the same diameter as the weapon barrel.

3. The breechblock as defined in claim 1, wherein:

said locking body is provided with a radial groove;

a spring-loaded lever extending into said radial groove; and means for pivotably mounting said spring-loaded lever at said breechblock housing.

4. The breechblock as defined in claim 1, wherein:

said locking body is provided with contact surfaces for the breechblock body.

5. A breechblock for an automatic firing weapon, comprising:

a breechblock housing having a bore;

a weapon barrel mounted in said bore;

a breechblock body displaceably arranged in said breechblock housing;

at least one blocking body provided for said breechblock body for locking the breechblock body with said breechblock housing;

a locking body inserted into said breechblock housing;

said locking body having at least one arresting surface at which bears the blocking body;

said locking body possessing a substantially sleeve-shaped configuration and having a rear end and a shoulder spaced from said rear end in the direction of the weapon barrel;

said rear end being provided with a cut-out extending substantially transversely with respect to the lengthwise axis of the weapon;

said cut-out having side walls at least one of which forms said at least one arresting surface;

said locking body being arranged substantially coaxially with respect to the weapon barrel in said bore of the breechblock housing;

said breechblock housing having shoulder means;

said weapon barrel having a rear end surface;

said locking body bearing at all times during operation of the weapon in contacting relationship by means of its rear end at said shoulder means of said breechblock housing and by means of its shoulder at said rear end surface of the weapon barrel.

* * * * *